US005441279A

United States Patent [19]

Messina

[11] Patent Number: 5,441,279

[45] Date of Patent: Aug. 15, 1995

[54] SMOKELESS CASINO GAMING TABLE

[76] Inventor: Gary D. Messina, 476 Cedar Ave., West Long Branch, N.J. 07764

[21] Appl. No.: 287,277

[22] Filed: Aug. 8, 1994

[51] Int. Cl.[6] ..... A47B 25/00; B01D 53/00

[52] U.S. Cl. ..... 273/309; 454/230; 55/385.1; 55/DIG. 18

[58] Field of Search ..... 273/309, 292, 274, 287; 55/385.1, 385.8, DIG. 18, DIG. 19; 454/230, 306, 338; 131/231

[56] References Cited

U.S. PATENT DOCUMENTS

| | | | |
|---|---|---|---|
| 2,572,120 | 10/1951 | Dixon | 454/230 |
| 3,273,323 | 9/1966 | Whitfield . | |
| 3,301,167 | 1/1967 | Howard et al. . | |
| 3,516,232 | 6/1970 | Gilbertson . | |
| 3,533,222 | 10/1970 | Gasperini . | |
| 3,890,126 | 6/1975 | Joseph | 55/385 |
| 3,893,457 | 7/1975 | van der Waaij | 128/847 |
| 4,248,162 | 2/1981 | Skeist | 454/230 |
| 4,623,367 | 11/1986 | Paulson | 55/385.8 |
| 4,647,295 | 3/1987 | Christ | 95/284 |
| 4,671,300 | 6/1987 | Grube et al. | 131/231 |
| 4,722,747 | 2/1988 | Armbruster | 55/316 |
| 4,732,591 | 3/1988 | Tujisawa et al. | 55/279 |
| 5,085,134 | 2/1992 | Hofstra et al. | 454/67 |
| 5,085,231 | 2/1992 | Johnson | 131/329 |
| 5,160,517 | 11/1992 | Hicks et al. | 55/385.1 |
| 5,240,478 | 8/1993 | Messina | 95/273 |
| 5,259,400 | 11/1993 | Bruno et al. . | |
| 5,264,015 | 11/1993 | Matsui | 55/467 |
| 5,306,207 | 4/1994 | Courts | 454/49 |

*Primary Examiner*—Benjamin H. Layno

*Attorney, Agent, or Firm*—Lerner, David, Littenberg, Krumholz & Mentlik

[57] ABSTRACT

A casino gaming table provides a smoke-free environment for the casino operator by discharging an air curtain or air barrier of purified filtered air. The gaming table includes a filter assembly which withdraws smoke contaminated air from ashtrays and smoking patrons who are playing the casino game. The purified filtered air is discharged adjacent the casino operator to provide a breathing zone free of cigarette smoke and related pollutants.

34 Claims, 9 Drawing Sheets

SMOKELESS CASINO GAMING TABLE

BACKGROUND OF THE INVENTION

The present invention relates in general to an air filtration system, and more particularly, to a smokeless casino gaming table which provides controlled capture of cigarette smoke and the like, while providing a safe zone of purified air for the casino employee through redirection and dilution.

Casino and gambling parlors cater to many patrons who smoke. Many of the no smoking zones and laws that restrict smoking in public places do not apply to casinos. Most casino operators recognize the health aspects and exposure that second hand smoke creates for both their employees as well as their patrons. The casinos do not ban smoking probably because huge numbers of patrons still continue to smoke and making customers comfortable and allowing them to keep patrons at the tables for longer periods will increase business. Severe restrictions or banning smoking altogether would only affect their revenues or force customers to competitors who have a less restrictive smoking policy. The large numbers of foreign visitors who smoke and gamble and who do not see the social stigma or health concerns attached to smoking continue to be highly regarded customers to most casinos.

In addition to the casino customers, employees are constantly being exposed to second hand smoke, especially those who must stand near the tables while dealing for long periods at a stretch, or other employees who are in close proximity to the pit area. Patrons have the option of moving to another table or repositioning themselves away from the direction of the smoke if it becomes a problem. Disrupting the table or having people continually moving to another table is not the best situation for the house. The dealers usually do not have the option of relocating. The potential liability is that employees who are constantly exposed to an occupational risk or hazard (second hand smoke) could have potential grounds for a suit, if they were diagnosed with a respiratory ailment such as lung disease when they never smoked, but were exposed to smoke during the performance of their job duties.

Some casinos make an effort to exhaust huge amounts of air through their ventilation systems or condition it prior to recirculation back into public areas. However, these systems are mostly designed to provide a comfortable environment for patrons within the casino. This basically means that on hot humid days the air is cooled and dehumidified and on cold days heated and humidified. They have little effect on health concerns with what is being inhaled. Moving vast amounts of air is a costly measure from the standpoint of maintenance, energy consumption, filtration, equipment maintenance and replacement. However, it is basically the only thing currently being done and although expensive, serves mostly for comfort purposes as described previously.

The areas where the smoke is normally being generated, mostly at the gaming tables, in some cases must travel considerable distances before it is being exhausted. The current systems use vast amounts of air filters and carbon or charcoal for elimination of airborne particulate which is smoke laden. Increased air movement and recirculation of air is a costly undertaking and sometimes prohibitive based upon the capabilities of the air handling system and location of the intake and exhaust ducts. Excess exhaust of conditioned air is costly since all exhausted air must be replaced with further conditioned air, i.e., heated or cooled.

There are known a number of devices adapted to provide purified air within a localized work environment. For example, Skeist, U.S. Pat. No. 4,248,162 discloses a table having intake grills for withdrawal of pollutants from the surrounding environment such as smoke. The pollutants are purified by an electrostatic precipitator arranged underlying the table. The clean air is discharged through an underlying air diffuser at low velocity.

Paulson, U.S. Pat. No. 4,623,367 discloses an umbrella table including an eating surface and an umbrella supported by a hollow mast. Air is upwardly discharged through a plurality of openings within the table surface by means of a motor. Smoke rising with the discharged air is trapped within the umbrella and returned via the mast to a filter unit underlying the table adjacent the motor. In this manner, air is recirculated while being filtered for pollutants such as smoke.

Johnson, U.S. Pat. No. 5,085,231 discloses a hat having a motor in a frusto-conical portion for withdrawing contaminated air from the surrounding environment which is filtered by an overlying filter. Clean air is discharged through a directional component underlying the visor portion of the hat towards the wearer's face.

Hicks, et al., U.S. Pat. No. 5,160,517 discloses a chair having a base mounted grill for withdrawing polluted air such as smoke from the surrounding environment. The polluted air is filtered by, for example, a HEPA (High Efficiency Particulate Air) filter within the chair base and discharged by a blower. In one embodiment, the clean air is discharged from the seat back towards the front of the chair. This creates a relatively quiescent vortex of purified air in the zone above the seat. In theory, contaminants in the vicinity of the chair are separated from the vortex by the relatively fast moving air stream which entrains them and carries them away.

The aforementioned air purification units suffer from a number of notable disadvantages. In particular, neither the hat in Johnson nor the chair in Hicks, et al. will perform the function that they were intended for, because they cannot provide adequate air movement to move enough airborne particulate without being impractical or uncomfortable for the user. In Skeist, an electrostatic filtering system is employed. The byproduct produced by electrostatic charging, i.e., ozone, is typically more detrimental than the smoke itself. Electrostatic charging, in fact, does not eliminate the gasses associated with cigarette smoke, only the particles. The efficiency of electrostatic charging diminishes as the unit is operated and continues diminishing as the plates continuously build up with particulate matter. The gasses, mostly ammonia are continually passed through, making this system a very inefficient and ineffective filtering system. In Paulson, there is no ability to separate the contaminated air from the filtered purified air to function as an air barrier. Accordingly, it can be appreciated that there is an unsolved need for an air filtration system which provides controlled capture of airborne pollutants while providing a safe zone of purified air for one or more individuals present within the contaminated environment.

SUMMARY OF THE INVENTION

One object of the present invention is to provide an air purification system which eliminates airborne pollutants such as cigarette smoke and the like, filters it, and then redirects the clean air in such a way that it protects someone who is in close proximity to the pollutant source.

Another object of the present invention is to provide an air purification system which creates a vertical air curtain, for both dilution as well as creating a clean air barrier.

The approach of the present invention is to eliminate cigarette smoke by control capture, dilution and removal. By eliminating the problem (smoke) as quickly as it is generated, it prevents it from being dispersed around the room, resulting in irritation to the eyes and respiratory tract. It prevents it from being breathed in by surrounding patrons and casino employees. Tobacco smoke is a particulate contaminant which consists of solid particles, liquid droplets and gasses, and constitutes more than 5,000 specific materials, most are water soluble, and contains tens of trillions of very fine particles of tar and nicotine. There are also numerous gases including acrolein, nitrogen dioxide, formaldehyde, hydrogen sulfide, ammonia and hydrogen cyanide contained in cigarette smoke. All of these gases are either irritants, carcinogens or toxic substances when present in sufficient concentrations. Studies have shown that the characteristics of aerosols, 92% are 0.5 micron or smaller, and 6% are 0.5 to 1 micron.

As these fine particles move through the air they coagulate and become larger size particles. Through electrostatic attraction many of these gas molecules will attach themselves to tiny dust particles in the air. The dust particles in turn will attach themselves to surfaces such as walls, ceilings, rugs, clothes. The gas molecules will eventually off-gas, thereby reintroducing the odor or smell to the room. Cleaning costs escalate as the components and structure must be maintained to keep the nicotine staining the fixtures in the room clean.

The present invention incorporates an airwash table design which is designed to do two things. One is to reduce the amount of smoke that is actually introduced to the air and the second is to isolate the casino employee by a rising curtain of purified air. The first design objective is accomplished by the strategic placement of air inlet grills placed along the outer periphery of the table surface. By drawing in contaminated air at this point, smoke being generated at the table surface by cigarettes sitting in ashtrays or people holding cigarettes while gambling, will be drawn into the vents for source or control capture. By the elimination of a large percentage of the smoke at this level, it prevents it from being introduced to the air.

The design of the casino gaming table is modular. It consists generally of four separate components, the table top, the filter module containing a blower and two support legs, each containing exhaust ducts. The table top has a series of intake ducts that are flush mounted with the surface, three on each half of the table in the case of a blackjack table. Perforated grills, with openings too small for chips or other items to pass through allow the smoke laden air to be drawn in. These intake ducts are connected by flexible ducts to a channeling system that is integrated under the table and draws contaminated air into a centralized air filter assembly. The filter assembly straddles the two support legs and is integrated into their design.

The filter assembly contains a series of filters. Pursuant to one embodiment, a prefilter, to eliminate the larger size airborne particles and help extend the life of the final filter, a final high efficiency particle removal filter to eliminate the submicron size particulates, and lastly through a carbon or charcoal cell type filter for elimination of gaseous molecules. These are accessed from the front side by a removable panel. The filters are sealed in place by a clamping mechanism. The blower exhausts the cleaned air through the duct system in each leg back into an exhaust duct that is located under the table top to the right and left of the dealer.

As to the second design objective, the air being exhausted forms an air curtain or barrier effect that will help dilute the air around the dealer that may pass over the table, especially when someone who is smoking exhales a plume of smoke in the dealer's direction. This exhausted air also allows air to be kept constantly moved away from the dealer. Without these air patterns being established, the air would tend to stagnate and the smoke would virtually hang in the air usually within the breathing zone of the dealer.

The benefits of this system of the present invention will provide source or control capture of airborne particulates, primarily being generated from cigarette smoke. It will eliminate much of the smoke before it has an opportunity to be introduced to the environment. The under table filtration system will filter out the particles generated by the cigarettes as well as the odor that the smoke produces from burning tobacco. By exhausting clean filtered air through the back of the unit and directing it on both sides of the dealer, the present invention is creating air patterns at the table level that will dilute, filter and eliminate the airborne contamination that the dealer as well as patrons are constantly being exposed to. By eliminating smoke at the source of its production and preventing it from being introduced throughout the casino, the air quality throughout the entire casino should improve.

One further aspect of the design is that when patrons are standing around the periphery of the table they serve as barriers and allow the air to remain confined within an area and be evacuated more quickly. This should have a residual benefit of cutting down on the housekeeping and cleaning requirements to the walls, mirrors, ceilings and rugs in which the smoke particles would normally coat and discolor. It should also increase the life cycle of the central ventilation system filters and the carbon trays that are designed to provide sufficient air changes to help eliminate the smoke.

In accordance with one embodiment of the present invention, there is disclosed an air filtration system comprising a table having a first location adjacent which at least one person may occupy and a second location adjacent which at least another person may occupy, inlet means in association with the table for withdrawing contaminated air from the first location, filtration means in association with the table for filtering the withdrawn contaminated air, and outlet means in association with the table for discharging the filtered air adjacent the second location.

In accordance with another embodiment of the present invention there is disclosed a gaming table comprising a base, a table top supported by the base for the play of a game thereon, the top including a first location adjacent which at least one player may occupy for the play of the game thereon and a second location adjacent which at least one operator may occupy for the control of the game, inlet means for withdrawing contaminated air from the first location, filtration means for filtering the contaminated air, and outlet means for discharging a filtered air stream adjacent the second location.

In accordance with another embodiment of the present invention there is disclosed a casino gaming table for providing a localized substantially smoke-free region for a game operator, the table comprising a base, a table top supported on the base for the play of a casino game thereon, the table top including a first peripheral region adjacent which at least one game player may be located for the play of a casino game on the table top, a second peripheral region adjacent which at least one game operator may be located for controlling the play of the casino game on the table top, inlet means within the first region of the table top for receiving smoke contaminated air from the surrounding environment, filter means within the base for filtering the withdrawn smoke contaminated air to provide substantially smoke-free air, outlet means within the second region of the table top for discharging the substantially smoke-free air, means for withdrawing the smoke contaminated air through the inlet means and the filter means for discharging the substantially smoke-free air through the outlet means to provide a substantially smoke-free air curtain between the game operator and the smoke contaminated air within the surrounding environment.

In accordance with another embodiment of the present invention there is disclosed a casino gaming table for providing substantially pollutant free air within at least the breathing zone of an operator present at a casino gaming table, the gaming table comprising playing means for playing a casino game thereon, withdrawing means for withdrawing pollutant containing air from a source thereof about the playing means, filtering means for filtering the pollutant containing air to provide substantially pollutant free air, and discharge means for discharging a curtain of substantially pollutant free air within at least the breathing zone of the operator present at the casino gaming table.

In accordance with another embodiment of the present invention there is disclosed a method of providing substantially pollutant free air within at least the breathing zone of an operator present at a casino gaming table, the method comprising withdrawing pollutant containing air from a source thereof, filtering the pollutant containing air to provide substantially pollutant free air, and discharging a curtain of the substantially pollutant free air within at least the breathing zone of the operator present at the casino gaming table.

BRIEF DESCRIPTION OF THE DRAWINGS

The above description, as well as further objects, features and advantages of the present invention will be more fully understood with reference to the following detailed description of a smokeless casino game table, when taken in conjunction with the accompanying drawings, wherein.

DETAILED DESCRIPTION OF THE PREFERRED EMBODIMENT

Figure 1:
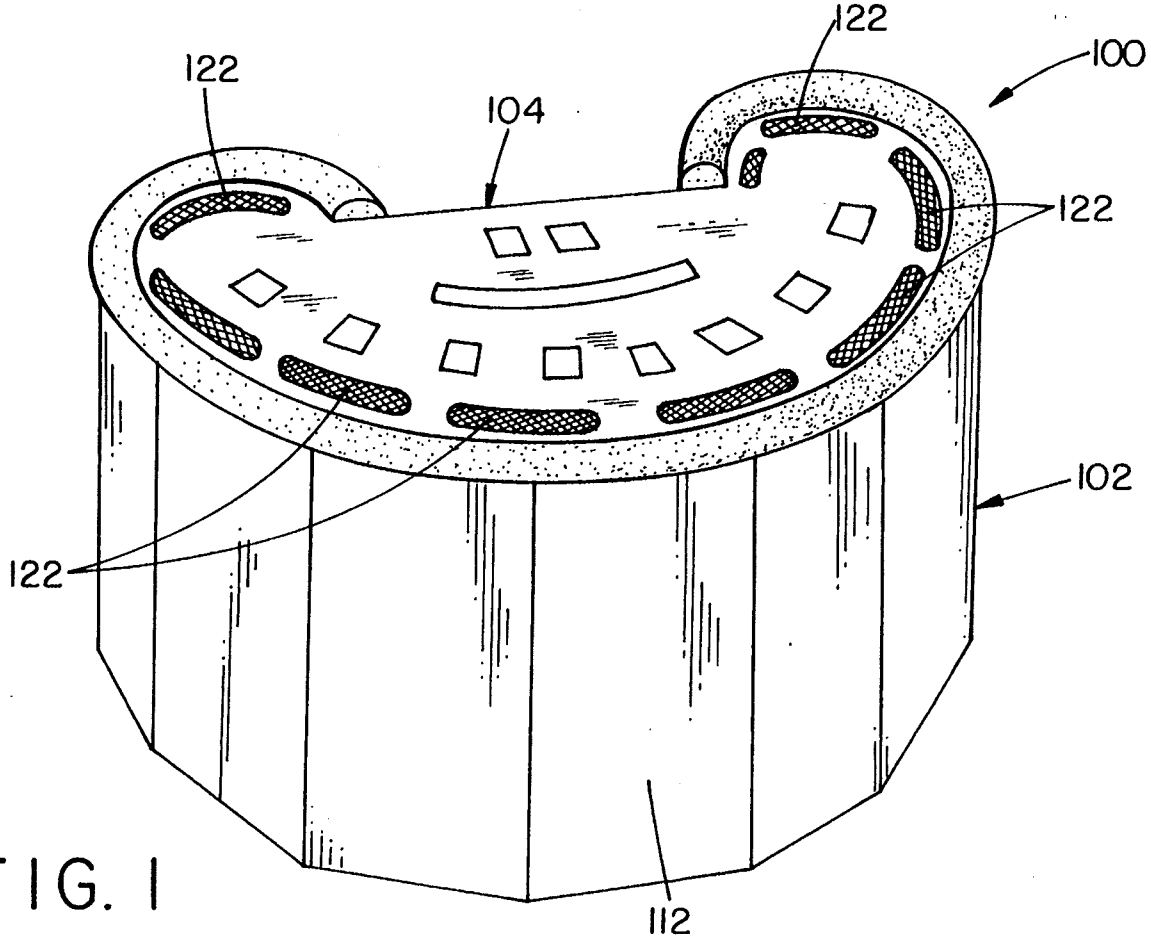
FIG. 1 is a perspective view of a casino gaming table for playing blackjack constructed to include an air filtration system in accordance with the present invention.

Referring now to the drawings wherein like reference numerals represent like elements, there is shown in FIG. 1 a casino gaming table 100 constructed in accordance with one embodiment of the present invention. The gaming table 100 is generally constructed from a base 102 and a table top 104 upon which one or more casino games may be played. For example, blackjack, baccarat, poker, roulette and the like. Although the present invention will be described with reference to a gaming table 100, it is to be understood that the present invention has utility in other than gaming tables. The present invention provides a very high volume of air movement within the area of the table top 104. The filtration process is continuous since contaminated air such as cigarette smoke and the like is continuously being drawn in and filtered, while an equal amount of clean air is being exhausted. This filtration process is being accomplished within the most critical area, that is, the occupant's breathing zone, e.g., about the occupant's face region. The contaminated air is being captured directly at the source, and immediately eliminated by a combination of filters within the base 102. The purified air is directed in the form of an air barrier or air curtain for the benefit of those persons adjacent the table top 104. In the case of a casino gaming table 100, the air barrier or air curtain isolates the casino employee from cigarette smoke emanating from game players.

Hence, it can be appreciated that the present invention may be used in, for example, industrial environments where there is the need to separate a worker from a source of contaminated air, lunch rooms to separate smokers from non-smokers, and the like.

Figure 2:
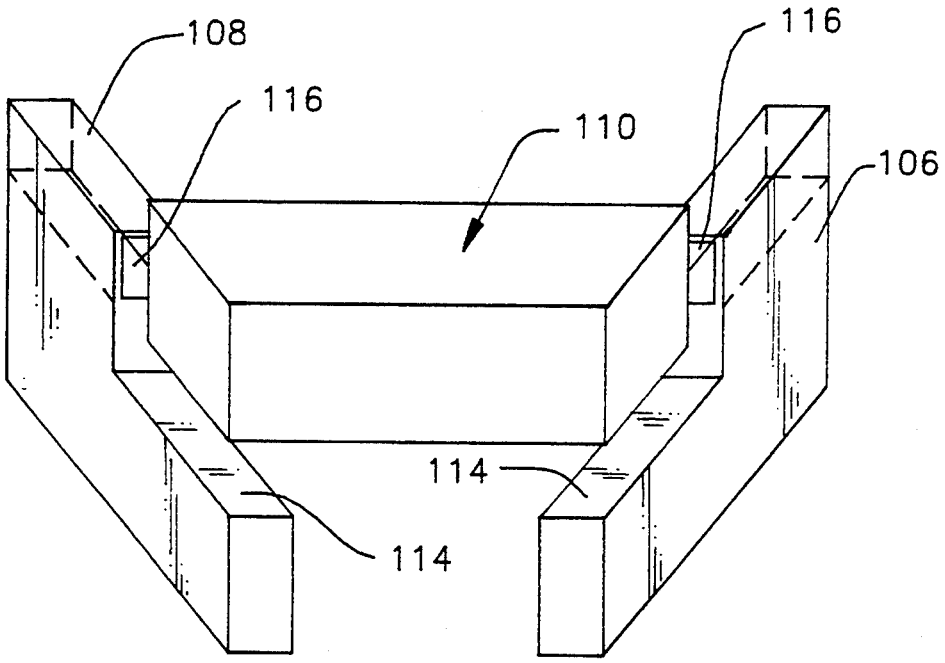
FIG. 2 is a perspective view, in unassembled relationship, of the individual components forming the base of the air casino gaming table.
Figure 3:
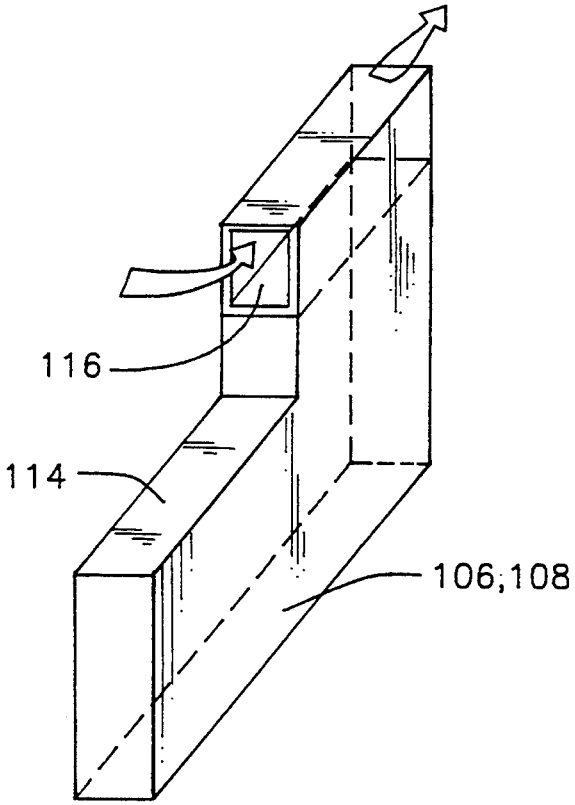
FIG. 3 is a perspective view of one leg forming a portion of the base of the casino gaming table.

For illustrative purposes only, the present invention will be described hereinafter with specific reference to a casino gaming table 100, and more particularly, to one for playing black jack. As shown in FIGS. 1 and 2, the base 102 is constructed from a pair of spaced apart L-shaped legs 106, 108 which support a centrally arranged filter module 110. The legs 106, 108 and filter module 110 when in assembled relationship, may be surrounded by a decorative outer shell 112 as shown in FIG. 1. The legs 106, 108 support thereacross the table top 104 overlying the filter module 110. As shown in FIG. 3, each of the legs 106, 108 includes a filter module support wall 114 and an elongated internal channel 116 for communicating with the filter module 110 as to be described hereinafter.

Figure 4:
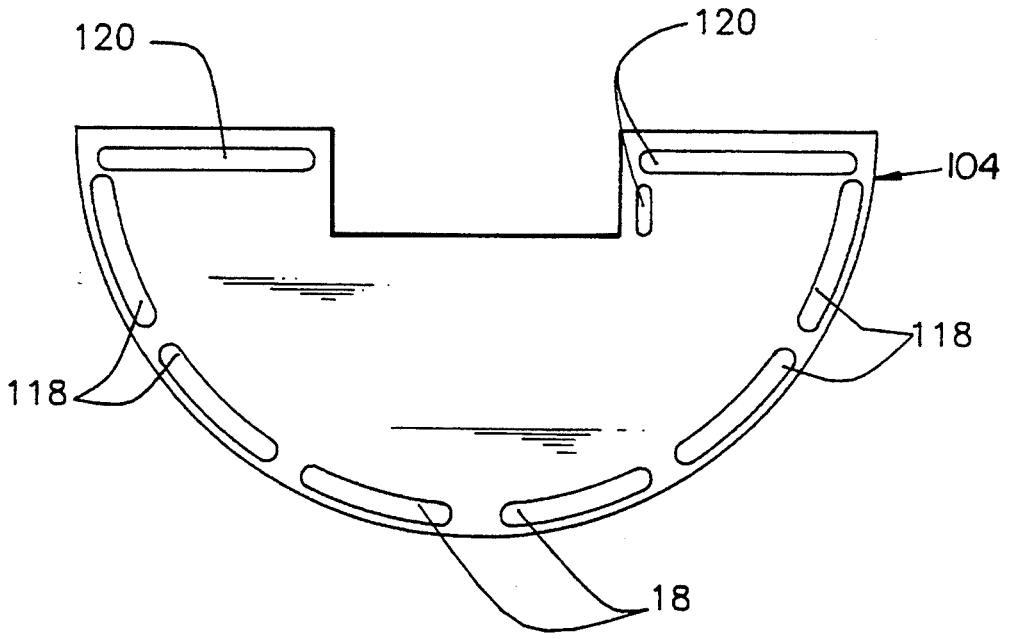
FIG. 4 is a top plan view of a casino game table top constructed to include an air filtration system in accordance with one embodiment of the present invention.
Figure 5:
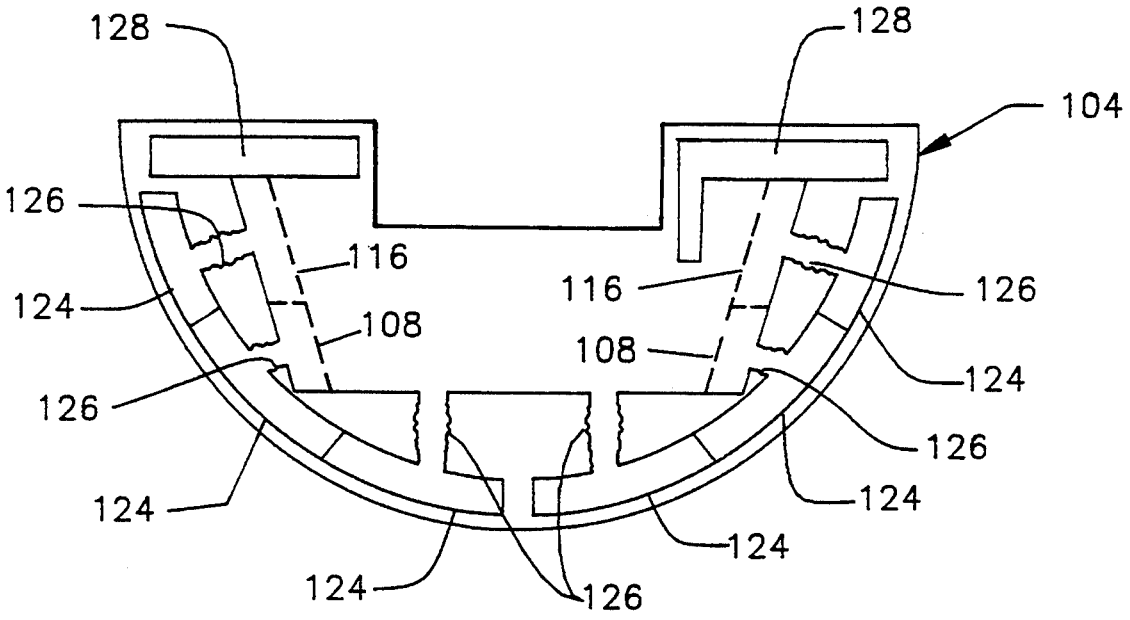
FIG. 5 is a bottom plan view of the casino gaming table top showing the arrangement of the duct system for withdrawing contaminated air and discharging clean filtered air in accordance with one embodiment of the present invention.

Referring to FIGS. 4 and 5, the table top 104 includes a plurality of elongated inlet openings 118 located adjacent a first peripheral region at which one or more game players are seated for the play of a casino game on the table top 104. Likewise, a plurality of elongated discharge openings 120 are arranged adjacent a second peripheral region where at least one game operator, i.e., casino employee, may be located for controlling the play of a casino game on the table top 104. The specific location for the inlet openings 118 and discharge openings 120 may be varied depending upon the particular needs at the time, as well as the game being played and the location of the casino employees and/or game players for the particular game being played. Preferably, the inlet openings 118 are arranged adjacent the patron or game player and locations for ashtrays and the like. Similarly, the discharge openings 120 are preferably arranged between the casino operator and the source of contaminated air such as cigarette smoke and the like, i.e., the patrons and/or cigarette ashtrays. Although the inlet openings 118 and discharge openings 120 have been illustrated as elongated oval-shaped openings, it is to be understood that rectangular, square, as well as other shaped openings may be employed. The openings 118, 120 are covered with a perforated grill 122, see FIG. 1, with openings too small for chips or other items to pass through, while allowing smoke laden air to be drawn therein.

The inlet openings 118 are connected to a central plenum within the filter module 110 by means of a duct system as shown in FIG. 5. More specifically, each of the inlet openings 118 communicates with a shroud 124 from which there extends a flexible duct 126. The flexible ducts 126 are, in turn, in fluid communication with the a central plenum within the filter module 110 as to be described. The discharge openings 120, on the other hand, are directly connected to channels 116 within the legs 106, 108 by means of a shroud 128. However, it is to be understood that similar previously described flexible ducts may be employed. It should be understood that the duct system for the inlet openings 118 and discharge openings 120 resemble conventional heating and air conditioning duct systems found in common use, however, other duct systems may be employed.

Figure 6:
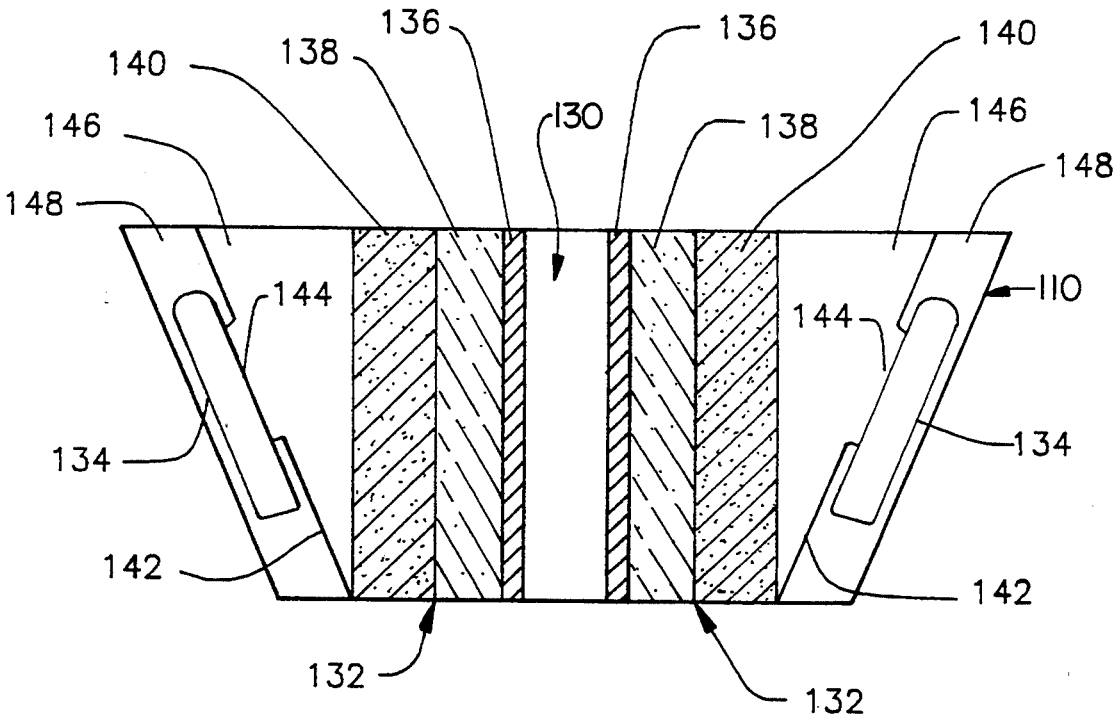
FIG. 6 is a partial cross-sectional view of a filter module in accordance with one embodiment of the present invention.

Referring to FIG. 6, the filter module 110 includes a central plenum 130 which is arranged in communication with inlet openings 118 by means of the flexible ducts 126. A filter assembly 134 is arranged on either side of the plenum 130, followed by a blower 134. The filter assembly 132 is constructed from a prefilter 136, a final high efficiency filter 138 and a carbon cell-type filter 140.

The prefilter 136 is typically of a low efficiency type having a particle retention size in the range of 10–15 microns or larger for trapping conventional airborne particles such as lint, dust, pollen, and the like. The high efficiency filter 138, on the other hand, is typically capable of capturing submicron size particles such as particulate smoke and the like. High Efficiency Particulate Air (HEPA) filters are particularly suitable for the high efficiency filter 138 pursuant to the present invention. HEPA filters have been widely utilized in the medical, health care and pharmaceutical fields as a means to trap airborne particles in the submicron range. This type of filter is widely recognized and has been specified in federal, military and pharmaceutical standards for more than thirty years.

The HEPA filter is constructed of extremely large concentrations of randomly oriented boron silicate fibers. This filtration media consists typically of 100% glass microfibers which range in mean diameter from 0.26–7 microns in size. Acrylic resin binders bond the various controlled blends of several glass fiber diameters to create a mat and matrix composed of numerous passages. The smaller the fiber diameter, the greater the capture and containment of small particles and the higher the efficiency of the filter. Preferably, the HEPA filter for use as filter 138 is capable of a minimum efficiency of 99.97% on 0.3 micron size particles, which provides the highest degree of filtration environments. In addition, it is to be noted that HEPA filters are capable of removing other airborne contaminants such as dust, pollen, mold, spores and the like.

The carbon cell-type filter 140 is designed specifically to remove gasses such as formaldehyde which are found in cigarette smoke. Carbon cell-type filters 140 are commercially available from Extraction Systems of Woonsocket, R.I. It is also contemplated that these absorption of the fumes and other vapors generated from cigarette smoke can be accomplished without the use of the carbon cell-type filter 140. In this regard, the individual fibers of the high efficiency filter 138 may be coated with Zeolite material available from Engelhard Industries. The Zeolite material may be tailored for the particular vapors found in cigarette smoke and adapted to adhere to the fiber composition of the high efficiency filter 138. The specific modifications to the Zeolite are obtainable by specification from Engelhard Industries.

Figure 7:
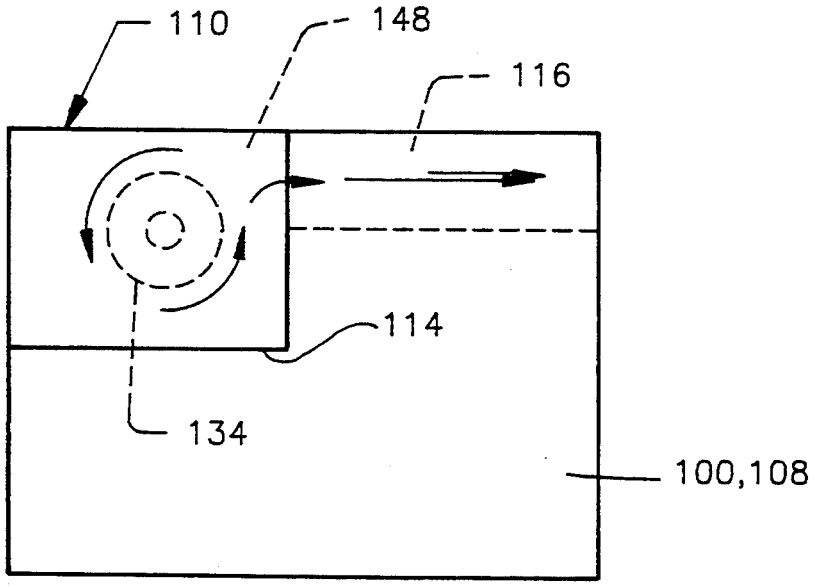
FIG. 7 is a side elevational view showing the filter module in operative relationship with the leg of the casino gaming table base.

Each of the blowers 134 are received within their own housing 142 on either side of the filter module 110 having an inlet opening 144 arranged in communication with the carbon cell-type filters 140 via their associated inlet plenum 146. The housings 140 are provided with an outlet opening 148 for discharge of filtered air by means of the blower 134. As shown in FIG. 7, outlet openings 148 are arranged in communication with channels 116 within the legs 106, 108 when the filter module 110 is supported upon support wall 114.

Figure 8:
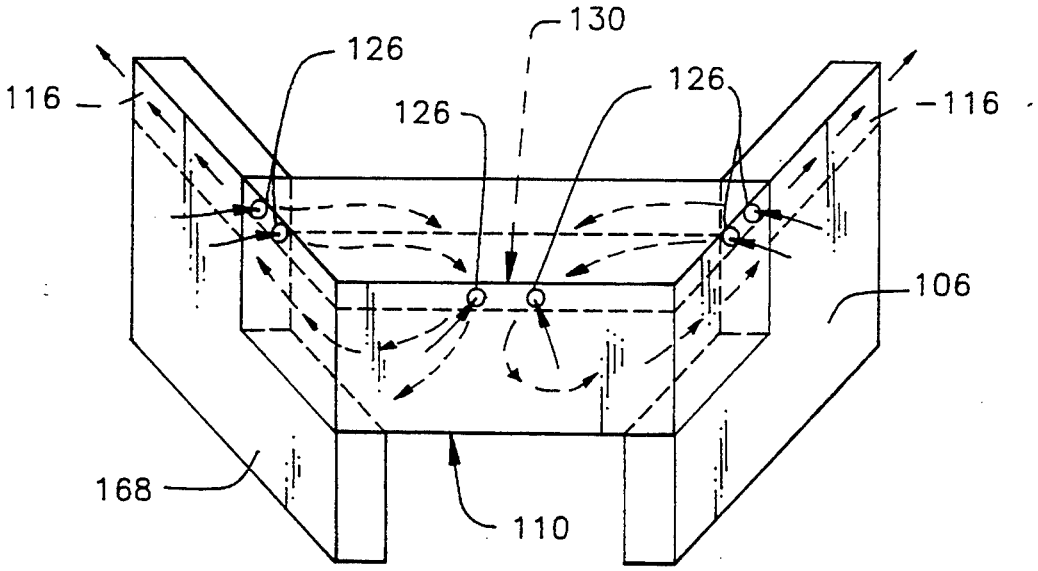
FIG. 8 is a perspective view of the casino gaming table base showing the air flow pattern for withdrawing contaminated air and discharging clean filtered air.
Figure 9:
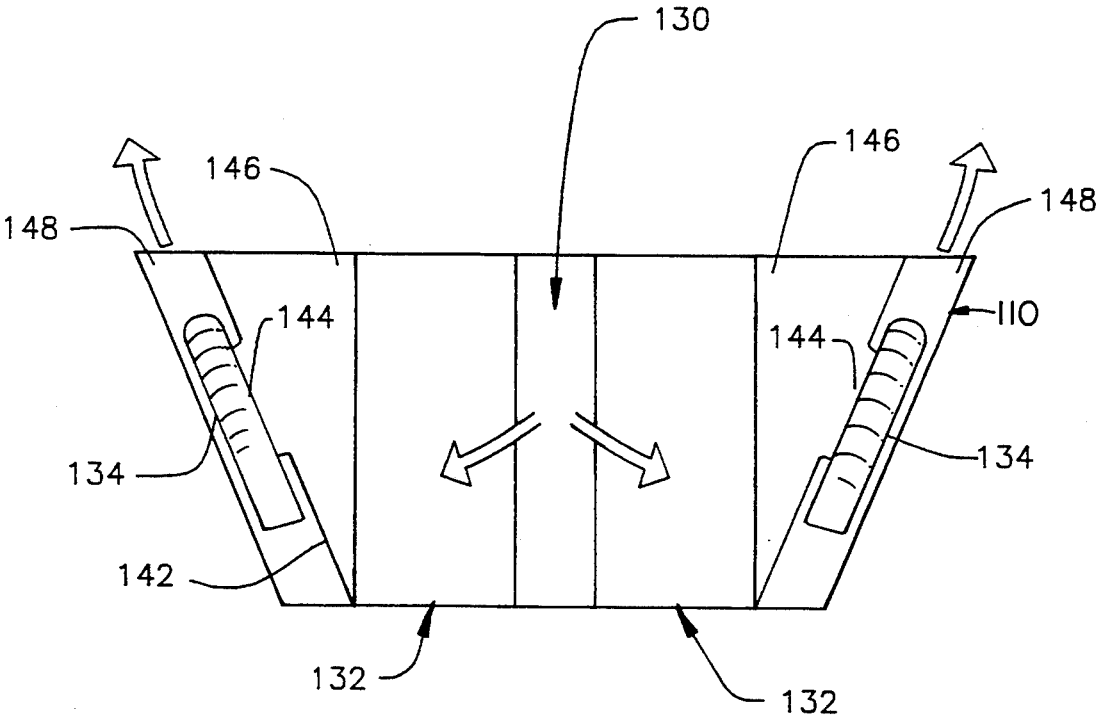
FIG. 9 is a diagrammatic front elevational view of the filter module disclosing the air flow pattern therethrough.

Referring to FIGS. 8 and 9, smoke filled or other airborne contamination laden air is drawn through inlet openings 118, shrouds 124 and ducts 126 into the central plenum 130 by means of the blowers 134. The contaminated air is pulled through the filter assemblies 134 and discharged as clean filtered air through outlet openings 148 to the discharge openings 120. At the discharge openings 120, the purified and filtered air is discharged upwardly as a continuous stream or curtain forming a barrier to protect and isolate the casino employee from the contaminated air adjacent the game players. By filtering the contaminated air through the game table 100 of the present invention and redirecting it as an air curtain or barrier, it allows both dilution of the smoke laden air, as well as preventing it from reaching the casino employees' breathing zone. Hence, by removing the smoke generated by the burning cigarettes at table top level, both in ashtrays and those being held by gaming players, the present invention creates source-capture which eliminates a large percentage of the smoke.

Figure 11:
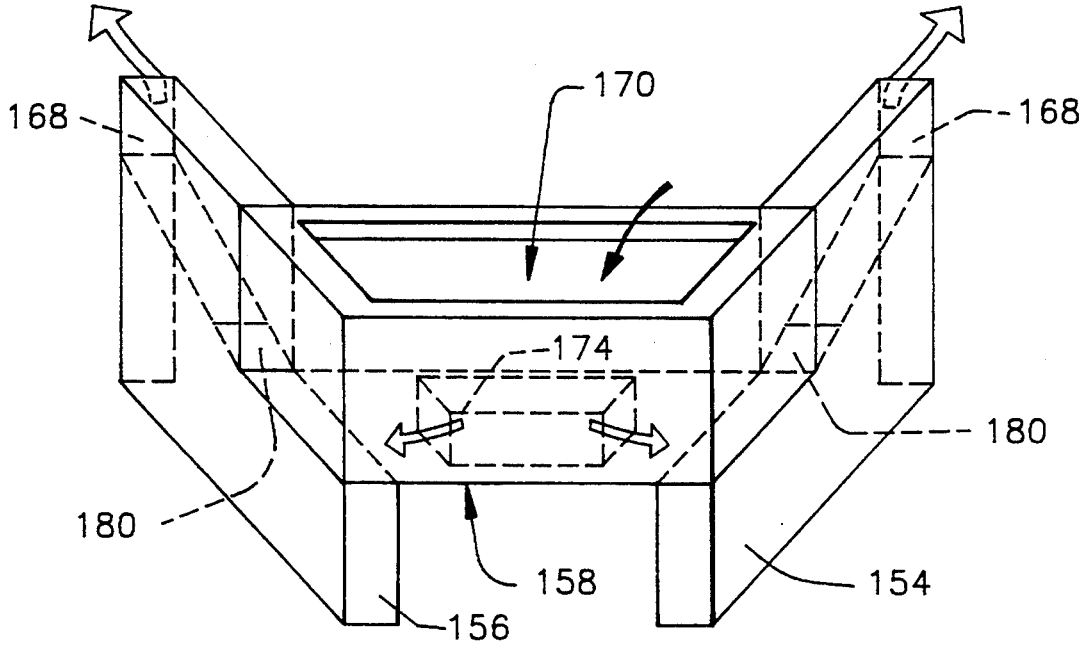
FIG. 11 is a perspective view of the casino gaming table base showing the air flow pattern for withdrawing contaminated air and discharging clean filtered air.
Figure 12:
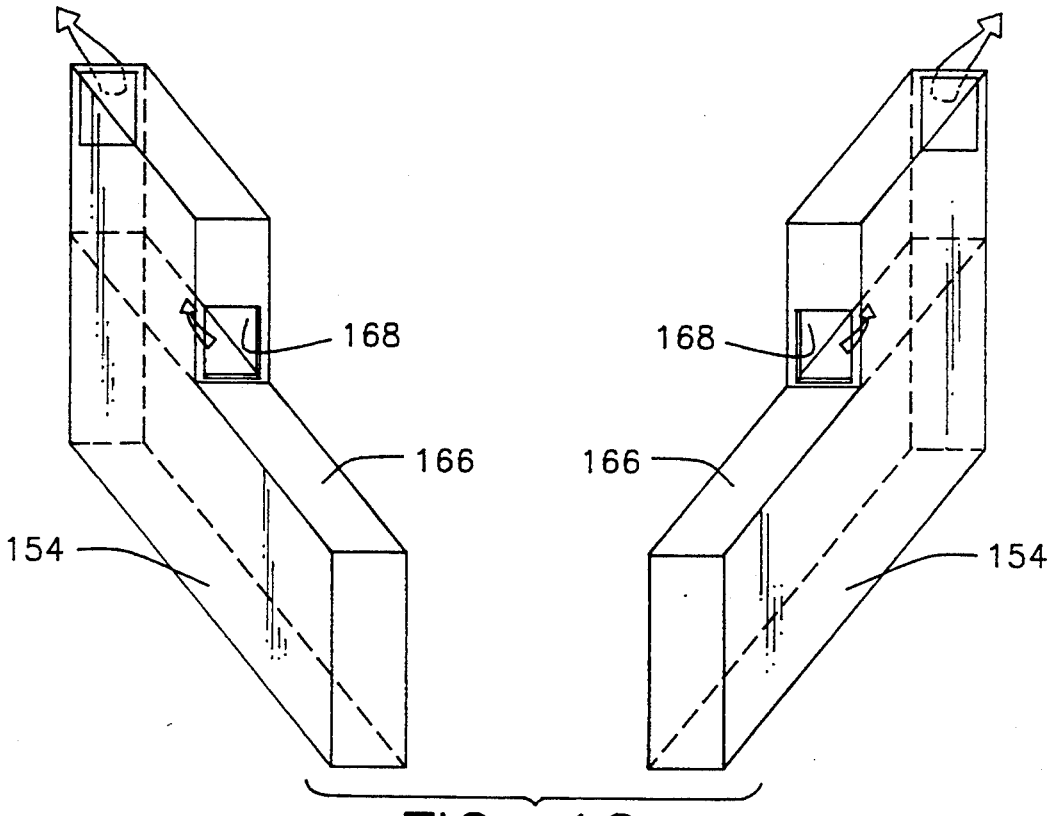
FIG. 12 is a perspective view of one leg forming a portion of the base of the casino gaming table.
Figure 13:
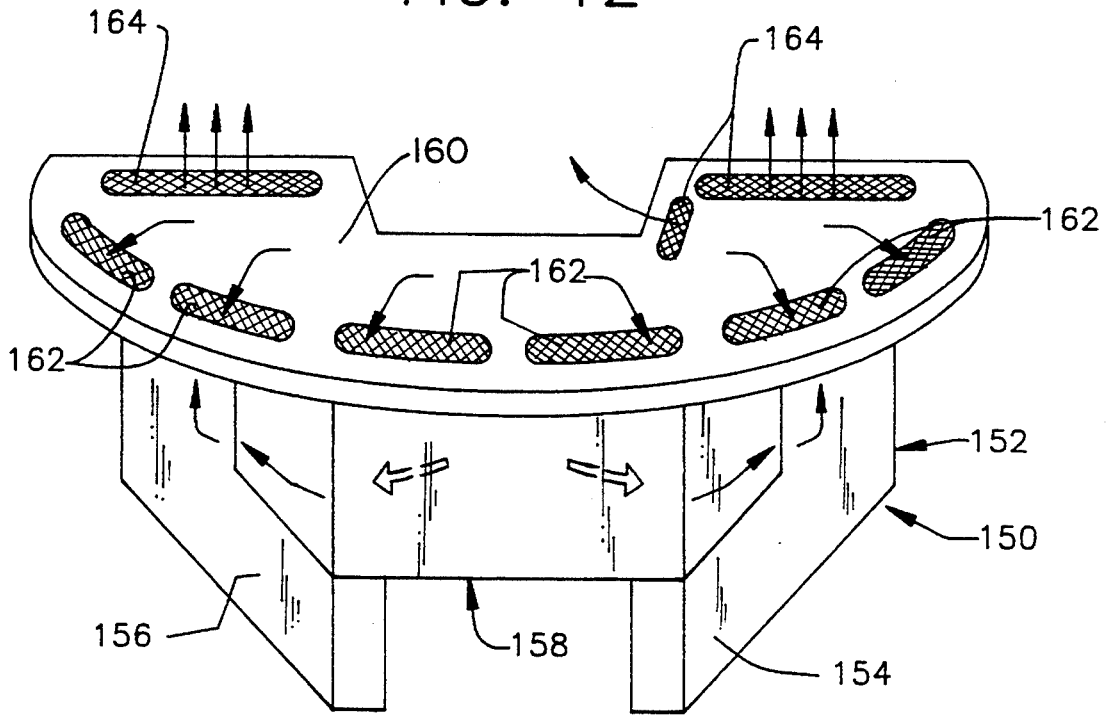
FIG. 13 is a perspective view of the casino gaming table base showing the air flow pattern for withdrawing contaminated air and discharging clean filtered air.

Referring now to FIGS. 10–15, there will be described a casino gaming table 150 in accordance with a more preferred embodiment of the present invention. As shown in FIG. 13, the gaming table 150 includes a base 152 constructed from a pair of spaced apart L-shaped legs 154, 156, a filter module 158, a table top 160 and an outer decorative shell (not shown). A plurality of inlet openings 162 are arranged peripherally along one side of the table top 104, while the opposing side of the table top supports a plurality of discharge openings 164. It will be appreciated that the gaming table 150 as thus far described is substantially identical to the gaming table 100 as described with respect to FIGS. 1–9. The essential difference between the gaming tables 100, 150 resides in the construction of the filter module 110.

Figure 10:
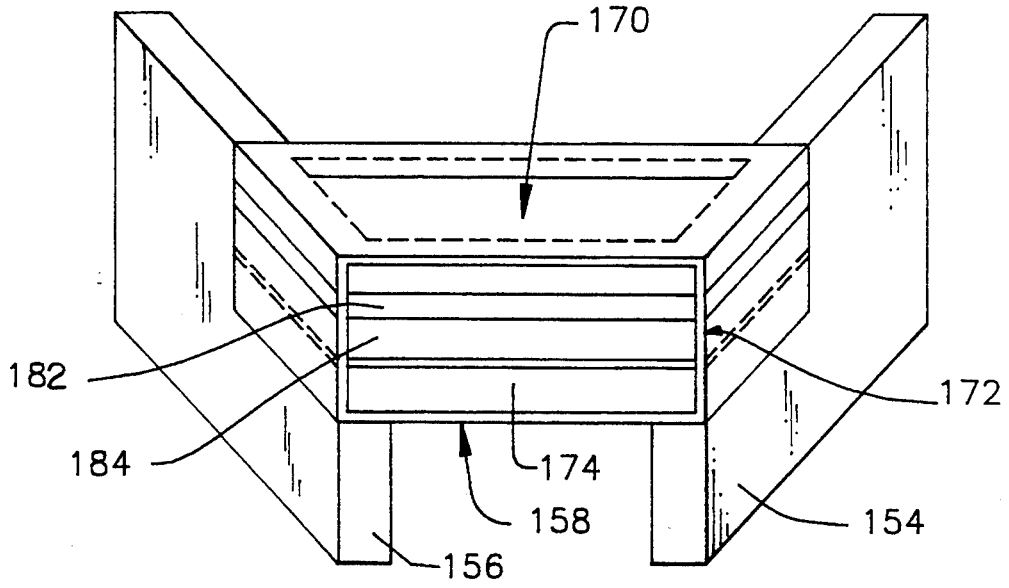
FIG. 10 is a perspective view of the base, including an air filter module, of a casino gaming table constructed to include an air filtration system in accordance with another embodiment of the present invention.
Figure 14:
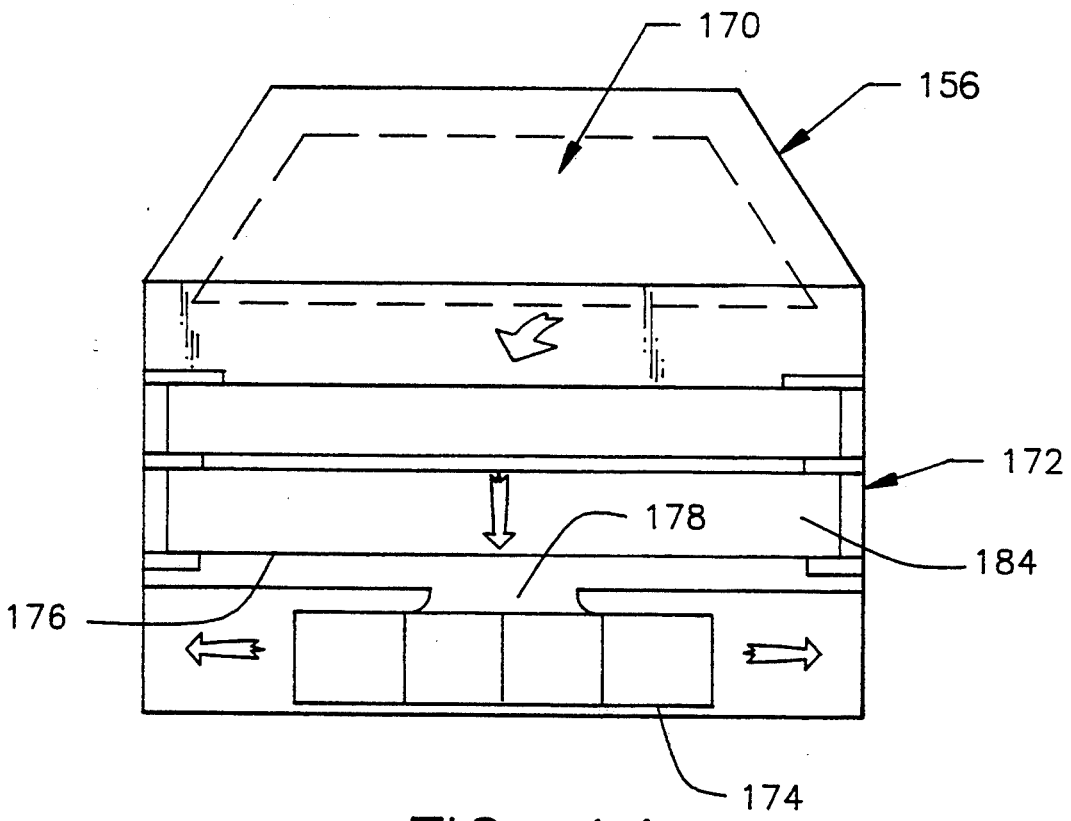
FIG. 14 is a partial cross-sectional view of a filter module in accordance with one embodiment of the present invention.
Figure 15:
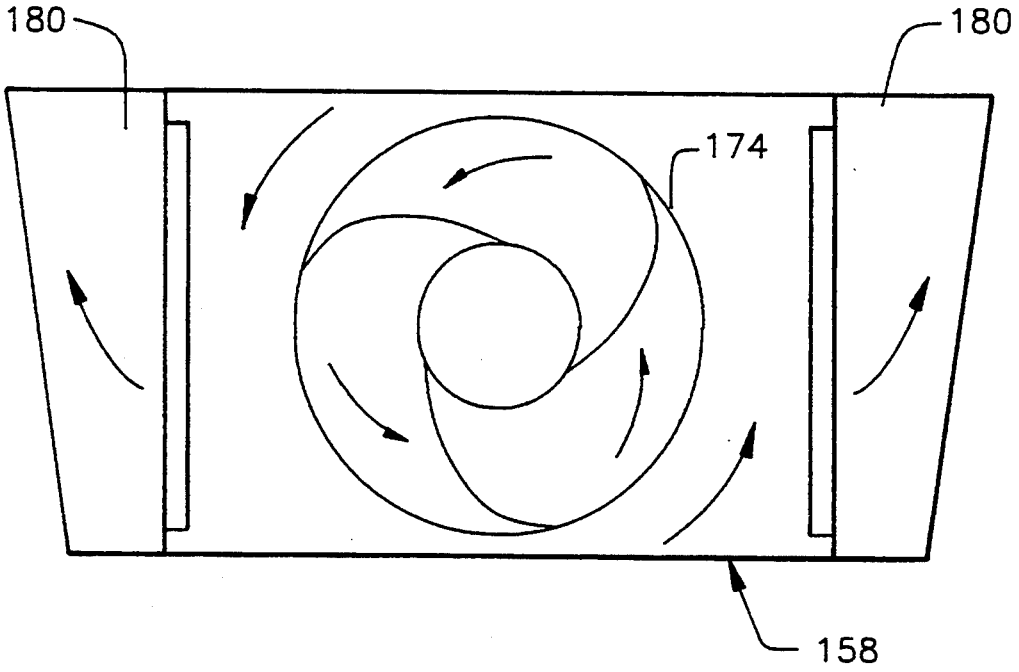
FIG. 15 is a top plan view of the filter module disclosing the blower unit and resulting air flow pattern therefrom.

As shown in FIG. 12, each of the legs 154, 156 includes a filter module support wall 166 and an upwardly sloping channel 168 which communicates between the filter module 158 and the discharge openings 164. Referring to FIGS. 10, 14 and 15, the filter module 158 includes a central plenum 170 overlying a filter assembly 172 which, in turn, is arranged overlying a single blower 174. The blower 174 is arranged within a housing 176 having a central opening 178 for drawing contaminated air through the filter assembly 172. Discharge channels 180 for the filtered air are provided on either side of the housing 176 within the filter module 158 in communication with channels 168 within legs 154, 156 as shown in FIG. 11.

The filter assembly 172 is constructed from a high efficiency filter 182 and a carbon cell-type filter 184 both of the type as previously described with respect to the filter assembly 132. From the foregoing construction, it will be appreciated that contaminated air initially enters through the plenum 170 by means of a similar duct system as disclosed with respect to the gaming table 100. The contaminated air will be first filtered with the particulate filter 182, and secondly by the carbon cell-type filter 184 by operation of the blower 174 which draws the contaminated air through the filter assembly 172. The purified filtered air will be discharged through channels 180, 168 to form a purified air barrier or air curtain upon emanating from discharge openings 164 about the casino employee. The purified filtered air which has been discharged has been thoroughly filtered of both airborne contamination as well as gases and vapors associated with cigarette smoke.

Figure 16:
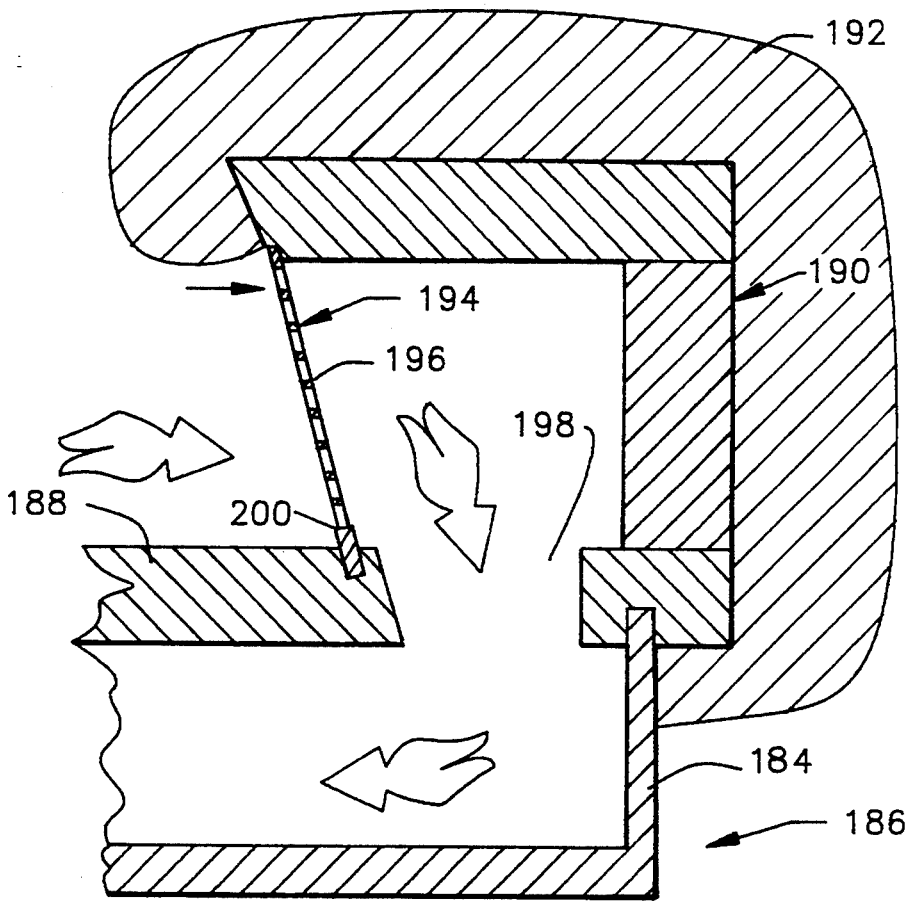
FIG. 16 is a partial cross-sectional view of a portion of a casino gaming table constructed in accordance with another embodiment of the present invention.

Referring now to FIG. 16, there is shown a portion of a casino gaming table 186 constructed in accordance with another embodiment of the present invention. In the embodiment shown, the table top 188 is circumferentially surrounded by a raised rail 190 covered by a cushion 192 as is typical of casino gaming tables such as blackjack, baccarat, and the like. The rail 190 is accordingly spaced from the playing surface of the table top 188 to accommodate a generally vertical grill 194 having a plurality of inlet openings 196. The grill 194 may be constructed as a single continuous grill circumscribing a portion of the table top 188 adjacent the gaming players, or a plurality of smaller individual grills separated by a vertical portion (not shown) of the rail 190. In either event, a plurality of openings 198 provided in the peripheral region of the table top 188 are arranged in communication with the grills 194 to enable withdrawing of contaminated air to an underlying shroud 124 which communicates with the filter module 110, 158 via an inlet plenum in the manner as previously described.

By arranging the grills 194 in a somewhat vertical orientation, as opposed to the horizontal orientation previously described, this arrangement prevents liquids from spilling into the inlet duct system. To this end, there may additionally be provided a small solid lip 200 on the order of about ¼ inch at the base of the grill 194 to prevent any liquids that may have been spilled on the table top 188 from flowing into the openings 196 within the grill 194.

Although the invention herein has been described with references to particular embodiments, it is to be understood that these embodiments are merely illustrative of the principles and application of the present invention. It is therefore to be understood that numerous modifications may be made to the embodiments and that other arrangements may be devised without departing from the spirit and scope of the present invention as defined by the claims.

What is claimed is:

1. An air filtration system comprising a table including a table top having a first location adjacent which at least one person may occupy and a second location adjacent which at least another person may occupy, inlet means in association with said table top for withdrawing contaminated air from said first location above said table top, filtration means in association with said table for filtering the withdrawn contaminated air, and outlet means in association with said table for discharging the filtered air adjacent said second location for isolating said another person from said contaminated air.

2. The air filtration system of claim 1, wherein said table comprises a casino gaming table.

3. The air filtration system of claim 1, wherein said inlet means comprises a plurality of inlet openings within said table top within said first location, said filtration means comprising a filter assembly within said filter module, and said outlet means comprising a plurality of outlet openings within said table top within said second location for discharging a curtain of filtered air therefrom.

4. The air filtration system of claim 1, wherein said outlet means discharges said filtered air at least in the breathing zone of said another person.

5. The air filtration system of claim 1, wherein said filtration means comprises the combination

6. The air filtration system of claim 1, wherein said filtration means comprises a high efficiency particulate air filter.

7. The air filtration system of claim 1, wherein said first location is devoid of said outlet means.

8. The air filtration system of claim 7, wherein said second location is devoid of said inlet means.

9. The filtration system of claim 1, wherein said inlet means is positioned within said first location and said outlet means is positioned within said second location.

10. A gaming table comprising a base, a table top supported by said base for the play of a game thereon, said top including a first location adjacent which at least one player may occupy for the play of said game thereon and a second location adjacent which at least one operator may occupy for the control of said game, inlet means in association with said table top for withdrawing contaminated air from a source thereof from said first location above said table top, filtration means for filtering the contaminated air, and outlet means for discharging a filtered air stream upwardly adjacent said second location for isolating said operator from the contaminated air source.

11. The gaming table of claim 10, wherein said gaming table comprises a casino gaming table.

12. The gaming table of claim 10, wherein said base includes a filter module for filtering said contaminated air.

13. The gaming table of claim 12, wherein said inlet means comprises a plurality of inlet openings within said table top within said first location, said filtration means comprising a filter assembly within said filter module, and said outlet means comprising a plurality of outlet openings within said table top within said second location for discharging a curtain of filtered air therefrom.

14. The gaming table of claim 13, wherein said filter assembly comprises the combination of a high efficiency particulate filter and a carbon filter.

15. The gaming table of claim 13, wherein said curtain of filtered air is discharged at least in the breathing zone of said operator.

16. The gaming table of claim 13, wherein said filter assembly includes a central plenum for receiving said contaminated air from said inlet means.

17. The gaming table of claim 13, wherein said outlet openings are arranged for discharging said curtain of filtered air within said second location adjacent said operator.

18. The gaming table of claim 10, wherein said inlet means is positioned within said first location and said outlet means is positioned within said second location.

19. A casino gaming table for providing a localized substantially smoke-free region for a game operator, said table comprising a base, a table top supported on said base for the play of a casino game thereon, said table top including a first peripheral region adjacent which at least one game player may be located for the play of a casino game on said table top, a second peripheral region adjacent which at least one game operator may be located for controlling the play of said casino game on said table top, inlet means within said first region in association with said table top for withdrawing smoke contaminated air from the surrounding environment above said table top, filter means within said base for filtering the withdrawn smoke contaminated air to provide substantially smoke-free air, outlet means within said second region of said table top for upwardly discharging said substantially smoke-free air, means for withdrawing said smoke contaminated air through said inlet means and said filter means for discharging said substantially smoke-free air through said outlet means to provide a substantially smoke-free air curtain between said game operator and said smoke contaminated air within said surrounding environment.

20. The casino gaming table of claim 19, wherein said filter means comprises a filter assembly including the combination of a high efficiency particulate filter and a carbon filter.

21. The casino gaming table of claim 19, wherein said inlet means and said outlet means comprise a plurality of openings.

22. The casino gaming table of claim 19, wherein said substantially smoke-free air curtain is discharged at least in the breathing zone of said operator.

23. A casino gaming table for providing substantially pollutant free air within at least the breathing zone of an operator present at a casino gaming table, said gaming table comprising playing means having a game surface for playing a casino game thereon, said playing means having a location adjacent which at least one casino game player occupies, withdrawing means for withdrawing pollutant containing air from a source thereof above the surface of said playing means adjacent the location of said at least one casino game player, filtering means for filtering said pollutant containing air to provide substantially pollutant free air, and discharge means for discharging a vertical curtain of said substantially pollutant free air above the surface of said playing means for isolating said operator from said pollutant containing air within at least the breathing zone of said operator present at said casino gaming table.

24. The casino gaming table of claim 23, wherein said filtering means comprises a filter assembly in communication between said withdrawing means and said discharge means.

25. The method of claim 24, filter including discharging said curtain of said substantially pollutant free air at a plurality of locations about said operator.

26. The method of claim 25, wherein said curtain of substantially pollutant-free air emanates from said casino gaming table.

27. The casino gaming table of claim 23, wherein said playing means comprises a table top having a game surface containing said withdrawing means and said discharge means, said withdrawing means and said discharge means comprising a plurality of openings.

28. The casino gaming table of claim 27, wherein said withdrawing means is arranged in a vertical orientation.

29. The casino gaming table of claim 23, wherein said playing means comprises a blackjack table.

30. The casino gaming table of claim 23, wherein said filtering means comprises a filter assembly overlying a blower, said blower comprising a portion of said withdrawing means and said discharge means.

31. A method of providing substantially pollutant free air within at least the breathing zone of an operator present at a casino gaming table having a surface for playing a casino game thereon, said method comprising withdrawing pollutant containing air from a source thereof above the surface of said gaming table, filtering said pollutant containing air to provide substantially pollutant free air, and discharging a curtain of said substantially pollutant free air upwardly within at least the breathing zone of said operator present at said casino gaming table.

32. An air filtration system comprising a table including a table top and a pair of spaced legs supporting said table top, said table having a first location adjacent which at least one person may occupy and a second location adjacent which at least another person may occupy, inlet means in association with said table for withdrawing contaminated air from said first location, filtration means including a filter module in association with said table for filtering the withdrawn contaminated air, said filter module supported by said legs underlying said table top, and outlet means in association with said table for discharging the filtered air adjacent said second location, said legs have a channel in communication between a blower within said filter module and said outlet means, said outlet means comprising a plurality of outlet openings within said table top within said second location for discharging a curtain of filtered air therefrom.

33. A gaming table comprising a base, a table top supported by said base for the play of a game thereon, said top including a first location adjacent which at least one player may occupy for the play of said game thereon and a second location adjacent which at least one operator may occupy for the control of said game, inlet means arranged in a vertical orientation for withdrawing contaminated air from said first location, filtration means for filtering the contaminated air, a rail peripherally circumscribing said top about said first location, said inlet means comprising a grill arranged between said top and said rail, and outlet means for discharging a filtered air stream adjacent said second location.

34. A casino gaming table for providing a localized substantially smoke-free region for a game operator, said table comprising a base, a table top supported on said base for the play of a casino game thereon, said table top including a first peripheral region adjacent which at least one game player may be located for the play of a casino game on said table top, a second peripheral region adjacent which at least one game operator may be located for controlling the play of said casino game on said table top, a rail peripherally circumscribing said top about said first region, inlet means arranged in a vertical orientation within said first region of said table top for receiving smoke contaminated air from the surrounding environment, said inlet means comprising a grill arranged between said top and said rail, filter means within said base for filtering the withdrawn smoke contaminated air to provide substantially smoke-free air, outlet means within said second region of said table top for discharging said substantially smoke-free air, means for withdrawing said smoke contaminated air through said inlet means and said filter means for discharging said substantially smoke-free air through said outlet means to provide a substantially smoke-free air curtain between said game operator and said smoke contaminated air within said surrounding environment.

* * * * *

UNITED STATES PATENT AND TRADEMARK OFFICE

CERTIFICATE OF CORRECTION

PATENT NO. : 5,441,279

DATED : August 15, 1995

INVENTOR(S) : Gary D. Messina

It is certified that error appears in the above-identified patent and that said Letters Patent is hereby corrected as shown below:

Column 10, line 58, after "combination" insert --of a high efficacy particulate filter and a carbon filter.--.

Signed and Sealed this

Fifth Day of December, 1995

*Attest:*

*Attesting Officer*

Bruce Lehman

BRUCE LEHMAN

*Commissioner of Patents and Trademarks*